US005251537A

United States Patent [19]

Hoshino et al.

[11] Patent Number: 5,251,537

[45] Date of Patent: Oct. 12, 1993

[54] HYDRAULIC DRIVING SYSTEM

[75] Inventors: Tatsuyuki Hoshino; Kunifumi Goto; Shigeki Kanzaki, all of Kariya, Japan

[73] Assignee: Kabushiki Kaisha Toyoda Jidoshokki Seisakusho, Kariya, Japan

[21] Appl. No.: 913,603

[22] Filed: Jul. 14, 1992

[30] Foreign Application Priority Data

Jul. 16, 1991 [JP] Japan ..... 3-175596

[51] Int. Cl.[5] ..... F04B 1/26

[52] U.S. Cl. ..... 91/506; 417/222.1

[58] Field of Search ..... 91/506; 417/218, 222 R

[56] References Cited

U.S. PATENT DOCUMENTS

| | | | |
|---|---|---|---|
| 2,888,810 | 6/1959 | Hann | 417/222.1 |
| 3,431,857 | 3/1969 | Jennings et al. | 417/218 |
| 4,028,010 | 6/1977 | Hopkins | 417/222.1 |
| 4,381,176 | 4/1983 | Kouns et al. | 417/222.1 |
| 4,723,892 | 2/1988 | Cowan | 417/222.1 |

FOREIGN PATENT DOCUMENTS 62-97302 6/1987 Japan .

*Primary Examiner*—Richard A. Bertsch
*Assistant Examiner*—Peter Korytnyk
*Attorney, Agent, or Firm*—Brooks Haidt Haffner & Delahunty

[57] ABSTRACT

A hydraulic driving system uses a variable capacity type swash plate piston pump that discharges a fixed quantity of operation oil. The piston pump is provided with a swash plate and a swash-plate tilt angle control mechanism. The pump is operated by the engine to drawing discharge oil whose quantity corresponds to the tilt angle of the swash plate. An oil passage provided with a restriction, is connected to the discharge side of the piston pump. A control valve functions in accordance with the pressure difference between the input and output sides of that restriction to feed operation oil to the tilt angle control mechanism via the oil passage. A tilt angle generating mechanism in the tilt angle control mechanism, causes the oil controlled by the control valve to act on the swash plate in order to increase its tilt angle. A tilt angle return mechanism in the tilt angle control mechanism urges the swash plate to decrease the tilt angle. A switching valve is provided between the tilt angle generating mechanism and the control valve, and is switchable between at two positions. With the valve located at the first switching position, the action of the operation oil to the tilt angle generating mechanism is suppressed. With the valve set at the second switching position, the operation oil is allowed to act on the tilt angle generating mechanism via the control valve. Consequently, when the pump is driven, the tilt angle is minimized to reduce the load on the engine.

14 Claims, 5 Drawing Sheets

HYDRAULIC DRIVING SYSTEM

BACKGROUND OF THE INVENTION

This application claims the priority of Japanese Patent Application No. 3-175596, filed Jul. 16, 1992, which is incorporated herein by reference.

1. Field of the Invention

The present invention relates to a hydraulic driving system equipped with a variable capacity type swash plate piston pump. More particularly, this invention is directed to a hydraulic driving system capable of discharging a fixed quantity of operation oil from the piston pump.

2. Description of the Related Art

Generally, an air conditioner mounted in a vehicle uses the vehicle's engine as power source, and is driven by a hydraulic driving system, which includes a hydraulic motor and a swash plate piston pump. Japanese Unexamined Utility Model Publication No. 62-97302 discloses a hydraulic driving system that drives an air conditioner. This system has its swash plate piston pump coupled drivably to the engine of the vehicle. This piston pump feeds a fixed quantity of operation oil to the hydraulic motor. A restriction is provided in an oil passage which connects the piston pump to the hydraulic motor. This system further comprises a flow control valve which controls the discharge quantity of the operation oil of the piston pump, based on the difference between the pressures at the input and output sides of the restriction.

The swash plate piston pump is provided with a spring for urging the swash plate in a direction so as to increase the tilt angle. The piston pump is also provided with tilt angle restriction means for restricting the increase in the tilt angle of the swash plate against the force of the spring. The spring and tilt angle restriction means constitute a mechanism for controlling the tilt angle of the swash plate. The tilt angle restriction means includes a control cylinder and a control piston. The control valve controls the oil pressure acting on the control cylinder, based on the difference in pressure between the input and output sides of the restriction. The oil pressure of the control cylinder acts on the swash plate via the control piston. The tilt angle of the swash plate is controlled on the basis of this oil pressure and the force of the spring. Consequently, the discharge quantity of the operation oil from the piston pump is adjusted in accordance with the tilt angle.

However, according to the conventional hydraulic driving system, when the engine stops or when the piston pump does not move, the tilt angle of the swash plate becomes greater, thus maximizing the discharge quantity. At the maximum tilt angle of the swash plate, the maximum load is applied to the engine, making it difficult to start the engine.

To start the engine more easily, the conventional hydraulic driving system has a clutch mechanism which is disposed intermediate the engine and the piston pump. The conventional hydraulic driving system deactivates the clutch mechanism, to functionally disengage the engine from the piston pump at the time the engine is started, and to activate the clutch mechanism to functionally re-engage them after the engine is started. In this manner, the load on the engine can be reduced to a minimal level.

SUMMARY OF THE INVENTION

It is therefore an object of the present invention to provide a hydraulic driving system capable of reducing the load on a power source, such as an engine, at the time a swash plate piston pump is activated, without disposing a clutch mechanism between the piston pump and the power source.

To achieve this object according to the present invention, the hydraulic driving system uses a variable capacity type swash plate piston pump which discharges a fixed quantity of operation oil. The piston pump of this system is provided with a swash plate and a swash-plate tilt angle control mechanism for controlling the tilt angle of the swash plate, the piston pump is operated by the engine to draw or discharge operation oil whose quantity corresponds to the tilt angle of the swash plate.

An oil passage provided with a restriction is connected to the discharge side of the piston pump. A control valve functions in accordance with the pressure difference between the input and output sides of that restriction, to feed operation oil to the tilt angle control mechanism via the oil passage.

A tilt angle generating mechanism in the tilt angle control mechanism, causes the operation oil controlled by the control valve to act on the swash plate in order to increase its tilt angle. A tilt angle return mechanism in the tilt angle control mechanism urges the swash plate to decrease the tilt angle. A switching valve is provided between the tilt angle generating mechanism and the control valve, and is switchable between at least two positions.

With the switching valve located at the first switching position, the action of the operation oil to the tilt angle generating mechanism is suppressed. With the switching valve set at the second switching position, the operation oil is allowed to act on the tilt angle generating mechanism via the control valve.

BRIEF DESCRIPTION OF THE DRAWINGS

The invention, together with objects and advantages thereof, may best be understood by reference to the following description of the presently preferred embodiment together with the accompanying drawings in which.

DETAILED DESCRIPTION OF THE PREFERRED EMBODIMENT

A preferred embodiment of the present invention will now be described referring to FIGS. 1 through 5.

Figure 1:
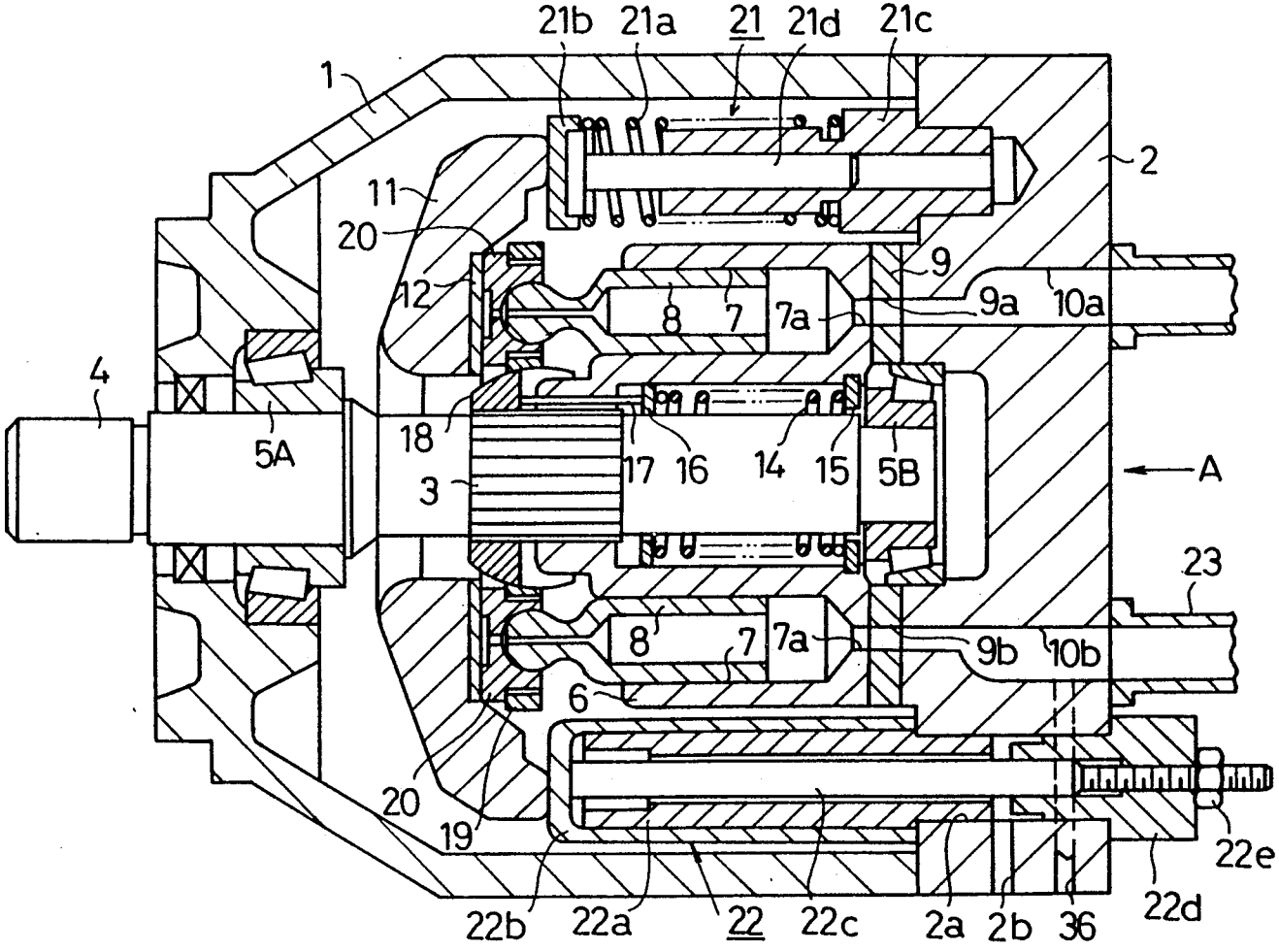
FIG. 1 is a sectional side view illustrating a piston pump assembly according to one embodiment of the present invention.

As shown in FIG. 1, a piston pump A has a hollow casing 1 and an end plate 2, for covering the end opening of the casing 1. A drive shaft 4 is supported rotatably in the casing 1 and the end plate 2 by bearings 5A and 5B. A cylinder block 6 is supported on the drive shaft 4 via a spline 3 in such a way as to be slidable and rotatable integrally with the drive shaft 4. The drive shaft 4 is drivably coupled to a vehicular engine E (see FIG. 3), and starts rotating upon activation of the engine E. The cylinder block 6 has a plurality of bores or cylinders formed therein around the center of its axis. A piston 8 moves slidably within each bore 7.

A valve plate 9 is fixed to the inner wall of the end plate 2. The valve plate 9 has an arched suction port 9*a* and an arched discharge port 9*b* which face the locus of an opening 7*a* of each bore 7. Formed in the end plate 2, are a suction passage 10*a* and a discharge passage 10*b*, which respectively communicate with ports 9*a* and 9*b*. As the drive shaft 4 rotates, the individual bores 7 communicate with the suction port 9*a* and the discharge port 9*b* alternately. In the casing 1, a swash plate 11 is supported tiltably around the axis perpendicular to the drive shaft 4. A ring 12 is mounted on the swash plate 11. A plurality of shoes 20, corresponding to the individual pistons 8, are provided on the ring 12. The individual shoes 20 are held slidably on the ring 12 by a shoe retainer 19. In the cylinder block 6, a pivot 18 is mounted on the drive shaft 4 to be slidable along the axis of the drive shaft 4, with its spherical outer surface slidably engaging the center hole of the shoe retainer 19. A spring 14 is fitted over the drive shaft 4. The force of the spring 14 acts on the cylinder block 6 through a spring retainer 15. The spring force also acts on the shoe retainer 19 through a spring retainer 16, a pin 17 and the pivot 18. Accordingly, the individual shoes 20 are pressed against the ring 12.

Each piston 8 has its tip coupled rotatably and unplugably to the associated shoe 20, so that the stroke of each piston 8 is set in accordance with the tilt angle of the swash plate 11. When the drive shaft 4 rotates with the swash plate 11 placed at a predetermined tilt angle, the individual pistons 8 reciprocate according to their strokes, thereby sucking operation oil into the respective bores 7 for expelling the operation oil therefrom.

Supported on the end plate 2, are a tilt angle restriction mechanism 21 and a tilt angle generating mechanism 22, which constitute a swash-plate tilt angle control mechanism. For the convenience of explanation, the top and bottom of the piston pump A are set in the description of this embodiment in association with the top and bottom of the sheet of FIG. 1.

The tilt angle generating mechanism 22 is mounted in a longitudinal opening 2*a* formed in the bottom of the end plate 2. The tilt angle generating mechanism 22 has a hydraulic control cylinder 22*a*, a control piston 22*b* and an adjustment shaft 22*c*. The control cylinder 22*a*, shaped cylindrical, is fitted in the longitudinal opening 2*a* and is secured therein at its proximal end. The control cylinder 22*a* extends in parallel to the drive shaft 4.

A support block 22*d* is securely fitted in the longitudinal opening 2*a*. The adjustment shaft 22*c* penetrates through the control cylinder 22*a* to be engaged with the support block 22*d*, such that its position is adjustable along the axis of the support block 22*d*. The adjustment shaft 22*c* is secured at an arbitrary adjusting position by a locking nut 22*e*. The piston 22*b*, shaped like a cap, is slidably fitted over the control cylinder 22*a* along the axis thereof. The operation oil is fed into the control cylinder 22*a* via the passage 2*b* and longitudinal opening 2*a* of the end plate 2. The control piston 22*b* presses the lower end portion of the swash plate 11 to increase the tilt angle. The tilt angle restriction mechanism 21 includes a bias spring 21*a*, a spring retainer 21*b*, a support pipe 21*c*, and an actuator bar 21*d*. The support pipe 21*c* is fitted at its proximal end in the upper interior of the end plate 2, and extends in parallel to the drive shaft 4. The actuator bar 21*d* is fitted slidably into the support pipe 21*c*, with the spring retainer 21*b* mounted on its tip. The bias spring 21*a* is disposed between the spring retainer 21*b* and the proximal end of the support pipe 21*c*. The force of the bias spring 21*a* acts on the upper end portion of the swash plate 11 via the spring retainer 21*b*, for urging the swash plate 11 to reduce the tilt angle. The tilt angle Θ of the swash plate 11 is controlled on the basis of the balance of the force of the bias spring 21*a* with the internal pressure of the control cylinder 22*a*.

Figure 2:
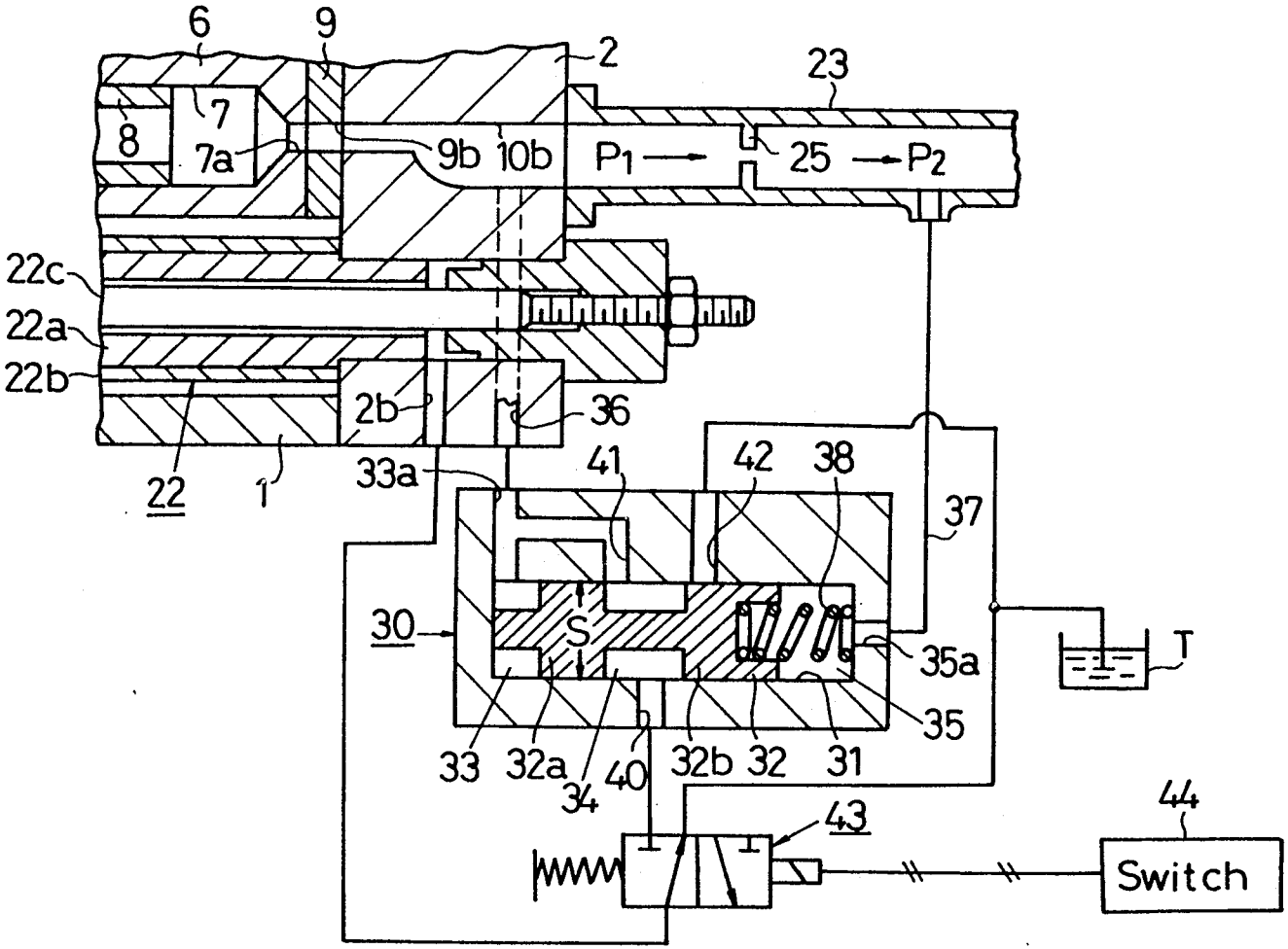
FIG. 2 is an enlarged cross sectional view of a control valve and part of the piston pump of FIG. 1.
Figure 3:
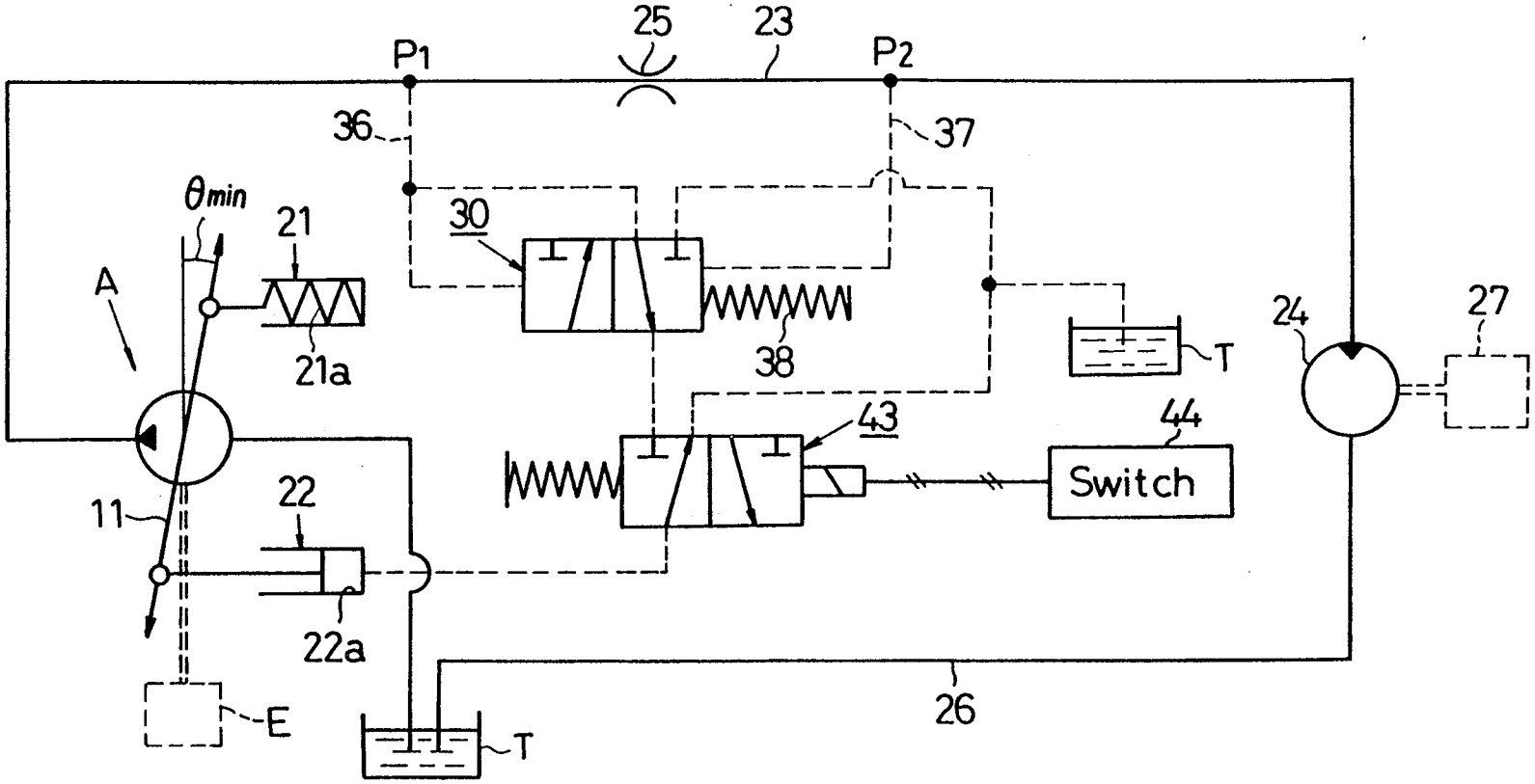
FIG. 3 is a circuit diagram of a hydraulic driving system according to the present invention, when an air conditioner is not in use.

When the control piston 22*b* cannot resist the force of the bias spring 21*a*, and moves backward due to a reduction in the internal pressure of the control cylinder 22*a*, the inner top face of the control piston 22*b* abuts on the tip of the adjustment shaft 22*c*, and limits the retraction of the control piston 22*b*. The minimum tilt angle $\Theta_{min}$ of the swash plate 11 can be determined by setting the retraction limit of the control piston 22*b*, via the positional adjustment of the adjustment shaft 22*c*. In this embodiment the minimum tilt angle $\Theta_{min}$ is set close to 0. As shown in FIGS. 2 and 3, the discharge passage 10*b* of the piston pump A is coupled to the suction side of a fixed displacement hydraulic motor 24, via an oil passage 23. The discharge side of the hydraulic motor 24 is coupled to an oil tank T via an oil passage 26. The operation oil in the oil tank T is led into the suction passage 10*a* of the piston pump A. Based on the oil supply from the piston pump A, the hydraulic motor 24 drives a compressor 27. This compressor 27 illustratively represents a vehicle air conditioning system.

As shown in FIG. 2, a control valve 30 is disposed in the proximity of the end plate 2. Provided in the control valve 30, is a cylinder 31 in which a spool 32 is slidably retained. The spool 32 has a pair of first and second stoppers 32*a* and 32*b* and a pair of small-diameter portions formed alternately. Both stoppers 32*a* and 32*b* closely contact the inner wall of the cylinder 31, to divide the cylinder 31 into three chambers: a first chamber 33, an inner chamber 34 and a second chamber 35. The second chamber 35 accommodates a spool spring 38, so that the spring action urges the spool 32 leftward (FIG. 2).

The control valve 30 has a first inlet port 33*a* and a second inlet port 35*a* formed therein, which respectively communicate with the first chamber 33 and the second chamber 35. A restriction 25 is provided in an oil passage 23. The first chamber 33 of the control valve 30 communicates with the discharge passage 10*b* (upstream of the restriction 25), via the first inlet port 33*a* and an intermediate passage 36 in the end plate 2. The second chamber 35 communicates with the oil passage 23, downstream of the restriction 25, via the second inlet port 35*a* and a passage 37.

The control valve 30 is also provided with a fourth port 41 which branches from the first inlet port 33*a* as well as a third port 40 and a fifth port 42. The fifth port 42 is coupled to the tank T that retains operation oil. The third port 40 always communicates with the inner chamber 34, regardless of the position of the spool 32 in the cylinder 31.

With the spool 32 positioned on the left side, the fourth port 41 communicates with the inner chamber 34. When the spool 32 moves rightward, the first stopper 32*a* inhibits this fourth port 41 from communicating with the inner chamber 34. When the spool 32 is on the left side, the communication between the fifth port 42 and the inner chamber 34 is disabled by the second stopper 32*b*. When the spool 32 moves rightward, the fifth port 42 communicates with the third port 40 via the inner chamber 34.

Given that $P_1$ denotes the operation oil pressure at the upstream of the restriction 25 shown in FIG. 2 (i.e., the discharge pressure) and $P_2$ denotes the operation oil pressure at the downstream of the restriction 25, the internal pressures of the first chamber 33 and second chamber 35 are equal to $P_1$ and $P_2$ respectively. The oil pressure $P_1$ of the first chamber 33 acts as a force to thrust the spool 32 rightward. The oil pressure $P_2$ of the second chamber 35 and the force of the spool spring 38 act as a force to return the spool 32 leftward. The spool 32 is therefore held on the left side when the following equation (1) is satisfied $$P_1S \leqq P_2S + k\Delta_x \quad (1)$$

where S is the cross-sectional area of the cylinder 31; k is the spring constant of the spool spring 38; and $\Delta_x$ is the shrinkage length of the spool spring 38. At this time, the third port 40 communicates with the fourth port 41 and the fifth port 42 is closed by the second stopper 32*b*.

As the oil pressure $P_1$ rises with an increase in the amount of the operation oil discharged from the piston pump "A", the pressure difference between the input and output sides of the restriction 25 increases. When the following equation (2) is satisfied due to this pressure rise, $$P_1S > P_2S + k\Delta_x \quad (2)$$

the spool 32 moves rightward from the left-side position shown in FIG. 2 against the force of the spool spring 38. The first stopper 32*a* gradually closes the fourth port 41, and the second stopper 32*b* gradually opens the fifth port 42, for allowing communication of the port 42 with the third port 40.

Figure 4:
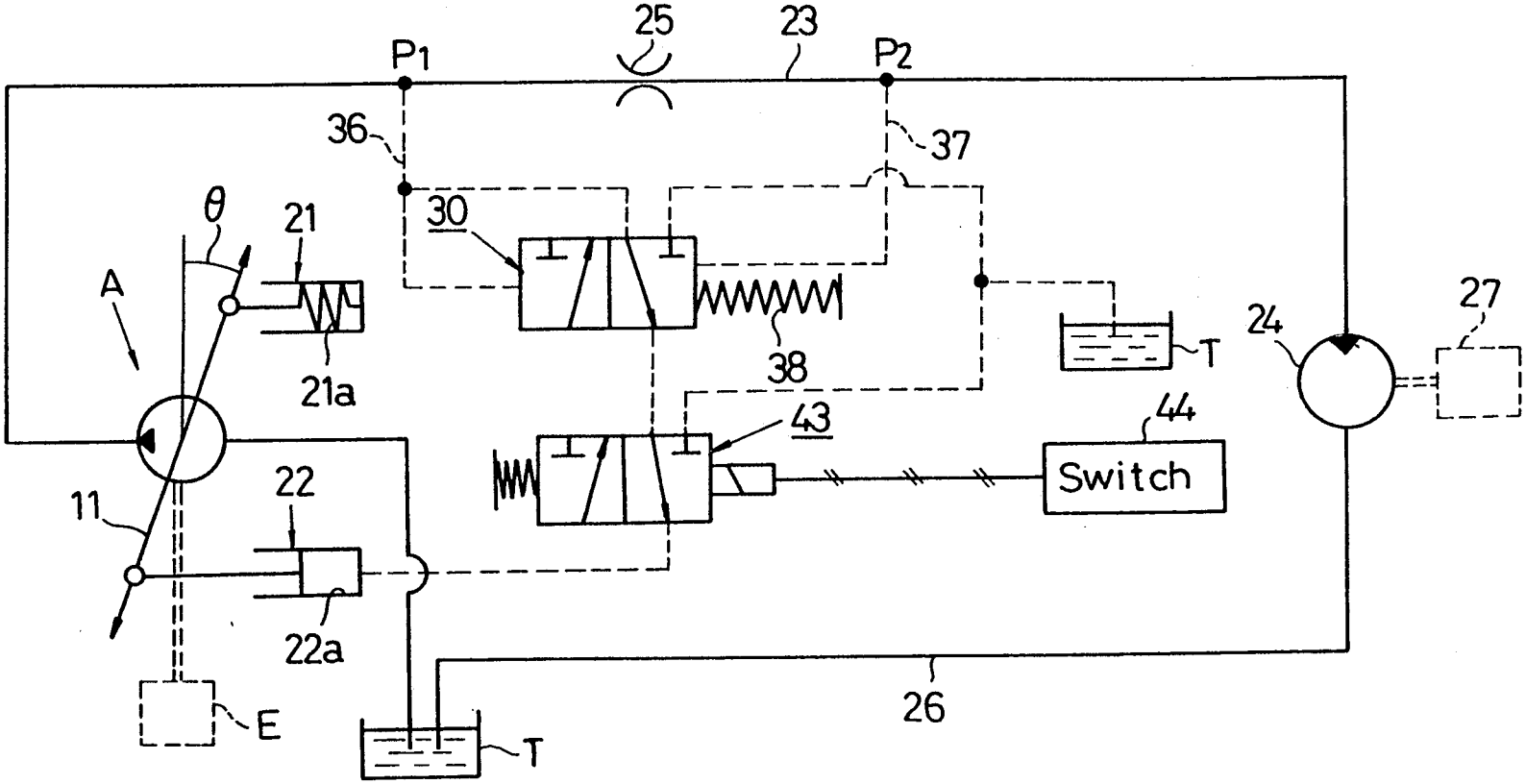
FIG. 4 is a circuit diagram of the hydraulic driving system of FIG. 3, when the air conditioner is activated.
Figure 5:
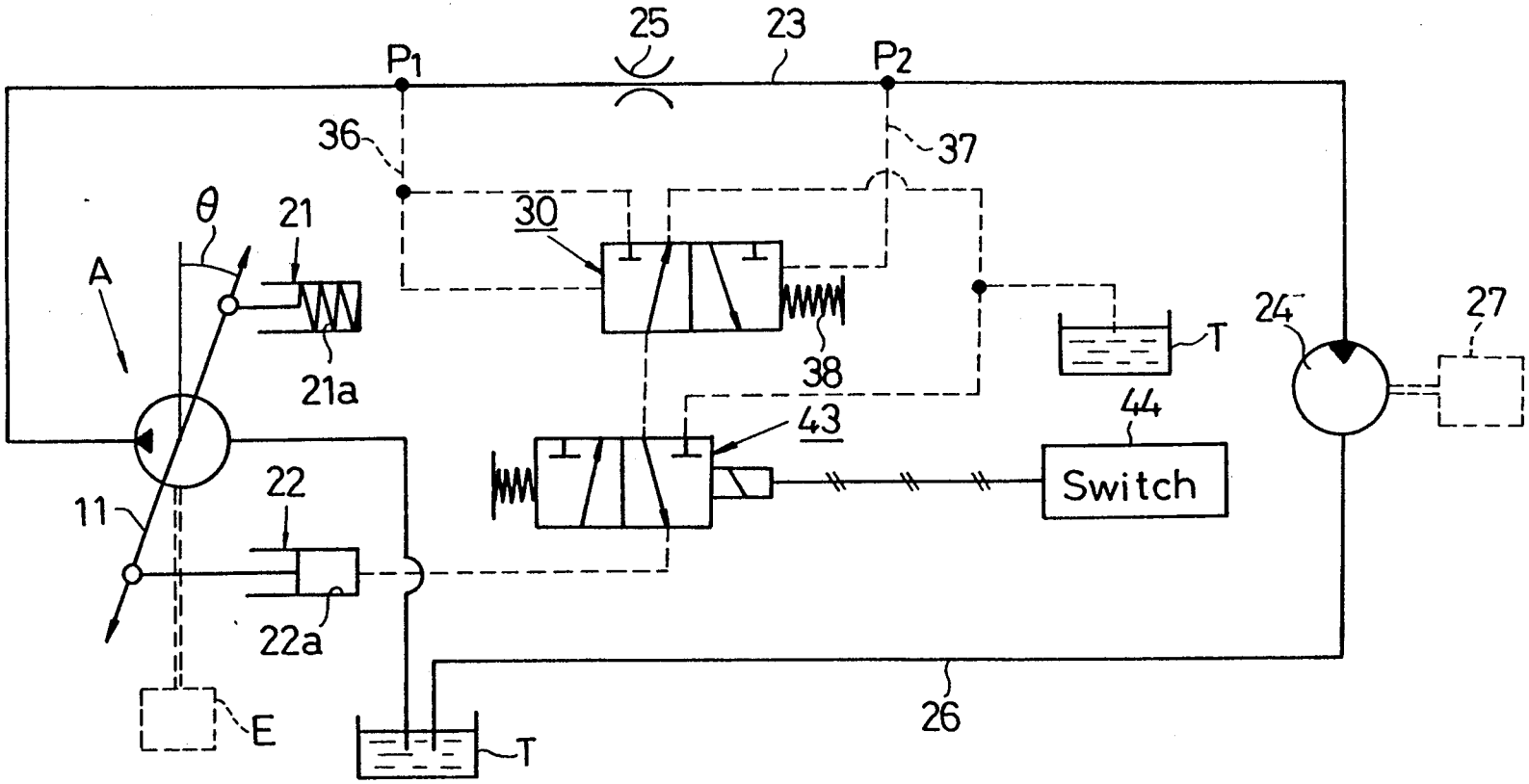
FIG. 5 is a circuit diagram of the hydraulic driving system of FIGS. 3 and 4, with the control valve actuated following the activation of the air conditioner.

As shown in FIGS. 2 through 5, the control cylinder 22*a* is connected to the third port 40 of the control valve 30, and the tank T via the oil passage 2*b* and an electromagnetic valve 43 (switching valve). The electromagnetic valve 43 is excited or unexcited in accordance with the ON/OFF action of a starting switch 44 which, when set on, activates the compressor 27. With the starting switch 44 set off, the electromagnetic valve 43 is located at the first switching position for connecting the control cylinder 22*a* to the oil tank T, as shown in FIGS. 2 and 3. On the other hand, when the starting switch 44 is set on, the electromagnetic valve 43 is set at the second switching position, in order to connect the control cylinder 22*a* to the third port 40 of the control valve 30, as shown in FIGS. 4 and 5.

When the air conditioner is not used, the starting switch 44 is set off for connecting the control cylinder 22*a* to the oil tank T, via the electromagnetic valve 43, as shown in FIG. 3. As a result, the tilt angle restriction mechanism 21 functions to permit the inner top face of the control cylinder 22*a* to abut on the adjustment shaft 22*c*, through the engagement of the swash plate 11 with the cylinder 22*a*. The swash plate 11 is therefore held at the minimum tilt angle $\Theta_{min}$.

According to this embodiment, the minimum tilt angle $\Theta_{min}$ can be set close to 0, by the positional adjustment of the adjustment shaft 22*c*. Even when the drive shaft 4 rotates in this condition, the piston pump A merely sucks or discharges a very small amount of operation oil. The operational load of the piston pump A (=power required to drive the piston pump A) is thus close to zero. When the engine E, which activates the piston pump A, is to be started when the air conditioner is not in use, the engine E can be smoothly started without having an excess load applied thereon.

Once the engine E is started, the starting switch 44 is switched on to use the air conditioner as shown in FIG. 4. Consequently, the control cylinder 22*a* is connected to the control valve 30 via the electromagnetic valve 43. With the swash plate 11 at the minimum tilt angle $\Theta_{min}$, therefore, a slight amount of operation oil is pumped out of the piston pump A and is fed to the control cylinder 22*a*, via the intermediate passage 36, fourth port 41, intermediate chamber 34, third port 40, and electromagnetic valve 43, as shown in FIGS. 2 and 4. Based on the pressure of this operation oil, the control piston 22*b* is thrust out against the force of the bias spring 21*a*, and causes the swash plate 11 to tilt and to increase the tilt angle. Thereafter, the discharge quantity of the operation oil from the piston pump A increases gradually. This increases the amount of the operation oil flowing in the oil passage 23, thus increasing the pressure difference between the input and output sides of the restriction 25 in the oil passage 23. Accordingly, equation (2) is satisfied.

The spool 32 then moves rightward from the left-side position shown in FIG. 2. In accordance with this movement, the fourth port 41 is closed and the fifth port 42 is open, so that the fifth port 42 communicates with the third port 40. Through this action, the control cylinder 22*a* is connected to the tank T, via the electromagnetic valve 43, third port 40, and fifth port 42, as shown in FIG. 5. Consequently, the operation oil in the control cylinder 22*a* is discharged into the tank T, and the tilt angle Θ of the swash plate 11, which has become too large, is reduced. When the tilt angle becomes so small that the oil pressure $P_1$ drops, the spool 32 returns to the left-side position and the action to increase the discharge quantity of the operation oil is repeated.

In other words, the control valve 30 properly moves the spool 32 so as to satisfy $P_1S = P_2S + k\Delta_x$, an equation determined by the predetermined diameter of the restriction 25 and the bias force of the spring 38. In accordance with this movement, the degree of the opening of the fourth port 41 or the fifth port 42 is continuously adjusted by the first stopper 32*a* or the second stopper 32*b*.

Briefly, according to the present invention, the internal pressure of the control cylinder 22*a* is controlled based on the adjusted degree of the opening of the port 41 or the port 42, to properly control the tilt angle Θ. The discharge quantity of the operation oil from the piston pump A (or the quantity of the operation oil to be fed to the hydraulic motor 24) is therefore kept at a generally constant control amount, regardless of the variation in the rotational speed of the engine E.

Further, according to the present invention, the tilt angle Θ of the swash plate 11 is set to the minimum tilt angle $\Theta_{min}$, when the piston pump A is not activated. The engine E that drives the piston pump A can therefore be activated smoothly without being overloaded. Therefore unlike the prior art, this embodiment does not need any clutch mechanism to be placed intermediate the piston pump A and the engine E, thus significantly simplifying the design of the hydraulic driving system.

Furthermore, according to the present invention, since the flow rate of oil in the oil passage 23 can generally be maintained at a constant control level, the hydraulic motor 24 can be driven at a constant speed. This allows the compressor 27 to be continuously driven at a constant speed, and to provide reliable refrigeration performance. In addition, the constant rotation of the compressor 27 will lengthen the durability of the air conditioner.

It is to be noted that the present invention is not limited to a hydraulic driving system for a hydraulic motor which drives the compressor of an air conditioner, but can be applied to a wide range of application for variable capacity type swash plate piston pumps.

What is claimed is:

1. A hydraulic driving system comprising:

a power source;

a variable capacity type swash plate piston pump, said piston pump having a swash plate and swash-plate tilt angle control means for controlling the tilt angle of said swash plate, said piston pump being connected to said power source for drawing and discharging operation oil;

an oil passage provided with a restriction means and connected to a discharge side of said piston pump, said restriction means including an input side and an output side;

a control valve operable as a function of the difference of pressures between said input and output sides of said restriction means, for feeding said operation oil to said tilt angle control means from said oil passage, and for allowing a generally constant quantity of operation oil to be discharged from said piston pump;

said tilt angle control means including:

tilt angle generating means for permitting said operation oil controlled by said control valve to act on said swash plate, for increasing its tilt angle;

tilt angle restriction means engaging said swash plate for urging said swash plate to decrease said tilt angle such that the capacity of said piston pump is minimized; and a switching valve disposed intermediate said tile angle generating means and said control valve, said switching valve being positionable between at least two positions;

whereby when said switching valve is located in a first switching position, the communication of said operation oil to said tilt angle generating means is interrupted, and when said switching valve is set in a second switching position, said operation oil is supplied to said tilt angle generating means.

2. The hydraulic driving system according to claim 1, wherein said piston pump comprises:

a suction passage and a discharge passage for said operation oil;

a drive shaft connectable to said power source;

a cylinder block rotatable integrally with said drive shaft;

a plurality of bores formed around said drive shaft in said cylinder block, each bore being able to communicate with said suction and discharge passages in accordance with rotation of said cylinder block;

a plurality of pistons, reciprocating in said bores, for drawing and discharging said operation oil to and from said respective bores, in accordance with the reciprocation movement of said pistons;

said swash plate is tiltable around an axis nearly perpendicular to said drive shaft; and each of said pistons is functionally coupled to said swash plate so as to have a stroke adjusted according to said tilt angle of said swash plate, and to have a relative rotation with said swash plate when said cylinder block rotates.

3. The hydraulic driving system according to claim 2, wherein said tilt angle restriction means and said tilt angle generating means extend along said drive shaft, and are connected to said swash plate at different positions.

4. The hydraulic driving system according to claim 3, wherein said tilt angle generating means comprises:

a cylinder into which said operation oil is to be supplied;

a control piston is fitted over said cylinder so as to cover said cylinder, and reciprocates along an axis of said cylinder, said control piston engages said swash plate, for tilting said swash plate in a direction, in order to increase said tilt angle by pressure of said operation oil; and an adjustment shaft, fitted in said cylinder and engageable at a distal end thereof with an inner surface of said distal end of said control piston, to restrict the movement of said control piston in a direction opposite to said swash plate.

5. The hydraulic driving system according to claim 3, wherein said tilt angle restriction means comprises:

a cylindrical support member;

an actuator bar is fitted movably into said support member, and has a washer provided at an outer end thereof; and a spring, disposed between said washer and said support member, for urging said washer in a direction to be engaged with said swash plate for causing said swash plate to reduce said tilt angle.

6. The hydraulic driving system according to claim 1, further comprising a tank for retaining said operation oil, when said switching valve is set in said first switching position.

7. The hydraulic driving system according to claim 6, further comprising a starting switch for selectively setting said switching valve to said first or second switching position, in accordance with an ON/OFF status of said starting switch.

8. The hydraulic driving system according to claim 1, wherein said power source is a vehicle engine, and wherein the hydraulic driving system is connected, via said oil passage, to a fixed displacement hydraulic motor connected to a vehicle compressor.

9. The hydraulic driving system according to claim 1, wherein said control valve comprises:

first and second ports respectively connected to upstream and downstream sides of said restriction means;

third and fourth ports openable and closable for supplying said operation oil to said tilt angle generating means;

a spool retained slidably in said control valve, for opening and closing said third and fourth ports;

a spring for urging said spool to open said third and fourth ports; and wherein when said oil pressure at said upstream side of said restriction exceeds a resultant force of oil pressure at said downstream side and the urging force of said spring, said spool closes said third and fourth ports to suppress the supply of said operation oil to said tilt angle generating mechanism.

10. The hydraulic driving system according to claim 1, wherein said tilt angle restriction means engages a periphery of said swash plate.

11. A hydraulic driving system comprising:

a power source;

a variable capacity type swash plate piston pump, said piston pump having a swash plate and swash-plate tilt angle control means for controlling the tilt angle of said swash plate, said pump being connected to said power source, for drawing and discharging operation oil;

said piston pump including:

a suction passage and a discharge passage for said operation oil;

a drive shaft connectable to said power source;

a cylinder block rotatable integrally with said drive shaft;

a plurality of bores formed around said drive shaft in said cylinder block, each bore being able to communicate with said suction and discharge passages in accordance with rotation of said cylinder block;

a plurality of pistons, reciprocating in said bores, for drawing and discharging said operation oil to and from said respective bores, in accordance with the reciprocation movement of said pistons;

said swash plate being tiltable around an axis nearly perpendicular to said drive shaft;

each of said pistons being functionally coupled to said swash plate so as to have a stroke adjusted according to said tilt angle of said swash plate, and to have a relative rotation with said swash plate when said cylinder block rotates;

an oil passage provided with a restriction means and connected to a discharge side of said piston pump said restriction means including an input side and an output side;

a control valve operable as a function of the difference of pressures between said input and output sides of said restriction means, for feeding said operation oil to said tilt angle control means from said oil passage, for allowing a generally constant quantity of operation oil to be discharged from said piston pump;

said control valve including:

first and second ports connected to upstream and downstream sides of said restriction means;

third and fourth ports openable and closable for supplying said operation oil to said tilt angle generating means, a spool retained slidable in said control valve for opening and closing said third and fourth ports;

a spring for urging said spool to open said third and fourth ports;

wherein when said oil pressure at said upstream side of said restriction exceeds a resultant force of oil pressure at said downstream side and the urging force of said spring, said spool closes said third and fourth ports to suppress the supply of said operation oil to said tilt angle generating mechanism, said tilt angle control mechanism including, tilt angle generating means for permitting said operation oil controlled by said control valve to act on said swash plate, for increasing its tilt angle;

tilt angle restriction means for urging said swash plate to decrease said tilt angle; and a switching valve disposed intermediate said tilt angle generating means and said control valve, said switching valve being positionable between at least two positions;

whereby when said switching valve is located in a first switching position, the action of said operation oil against said tilt angle generating means is suppressed, and when said switching valve is set in a second switching position, said operation oil is allowed to act on said tilt angle generating means.

12. The hydraulic driving system according to claim 11, wherein said tilt angle generating means comprises:

a cylinder into which said operation oil is to be supplied;

a control piston is fitted over said cylinder so as to cover said cylinder, and reciprocates along an axis of said cylinder, said control piston engages said swash plate, for tilting said swash plate in a direction, in order to increase said tilt angle by pressure of said operation oil; and an adjustment shaft, fitted in said cylinder and engageable at a distal end thereof with an inner surface of said distal end of said control piston, to restrict the movement of said control piston in a direction opposite to said swash plate.

13. The hydraulic driving system according to claim 11, wherein said tilt angle restriction means comprises:

a cylindrical support member;

an actuator bar fitted movably into said support member and having a retainer; and a spring, disposed between said retainer and said support member, for urging said retainer in a direction to be engaged with said swash plate, to cause said swash plate to reduce said tilt angle.

14. The hydraulic driving system according to claim 11, wherein said power source is a vehicle engine, and said hydraulic driving system is connected, via said oil passage, to a fixed displacement hydraulic motor which, in turn, is connected to a vehicle compressor.

* * * * *

UNITED STATES PATENT AND TRADEMARK OFFICE

CERTIFICATE OF CORRECTION

PATENT NO. : 5,251,537

DATED : October 12, 1993

INVENTOR(S) : T. Hoshino et al

It is certified that error appears in the above-indentified patent and that said Letters Patent is hereby corrected as shown below:

Column 3, line 17, at "In the casing" start new paragraph; line 68 at "The tilt angle" (second occurrence) start new paragraph.

Column 4, line 26 at "As shown" start new paragraph.

Column 6, line 22, at "Thereafter," start new paragraph.

Column 7, line 46, "tile" should read --tilt--.

Signed and Sealed this

Thirty-first Day of May, 1994

Bruce Lehman

*Attest:*

BRUCE LEHMAN

*Attesting Officer*

*Commissioner of Patents and Trademarks*